US006314625B1

(12) United States Patent
Ikeda

(10) Patent No.: US 6,314,625 B1
(45) Date of Patent: Nov. 13, 2001

(54) ZIPPER HANDLE STRUCTURE

(75) Inventor: Yasuhiko Ikeda, Toyonaka (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 09/519,466

(22) Filed: Mar. 6, 2000

(30) Foreign Application Priority Data

Mar. 12, 1999 (JP) ..... 11-066728

(51) Int. Cl.[7] ..... A44B 19/26
(52) U.S. Cl. ..... 24/429
(58) Field of Search ..... 24/429–431; D11/221; 294/3.6

(56) References Cited

U.S. PATENT DOCUMENTS 3,719,973 * 3/1973 Bell .
4,512,093 * 4/1985 Kolton et al. .
5,416,951 * 5/1995 Keyaki et al. .
5,535,491 * 7/1996 Allport .
5,878,467 * 3/1999 Yokota .

FOREIGN PATENT DOCUMENTS

89695-A2 * 9/1983 (EP) .
8-66207 * 3/1996 (JP) .

* cited by examiner

*Primary Examiner*—James R. Brittain
(74) *Attorney, Agent, or Firm*—Kanesaka & Takeuchi

(57) ABSTRACT

A zipper handle structure is formed of an attaching member to be swingably attached to a slider main portion of a zipper and having an opening and a side portion, a handle member having a through hole at one side, and a connecting member for connecting the attaching member and the handle member. The connecting member includes a first end portion with an engaging shaft, a second end portion with an engaging hole to be detachably engageable with the engaging shaft, and a center portion between the first and second end portions. When the connecting member connects the attaching member and the handle member, the first and second end portions are overlapped to engage the engaging shaft with the engaging hole, while the side portion of the attaching member is held between the first and second end portions adjacent the center portion and the engaging shaft is located in the through hole of the handle member. The handle member is swingably connected to the attaching member. In this structure, a user can easily exchange the handle member with a new one as desired, an attaching strength can be easily strengthened, and the shape and thickness of the handle member have no regulations.

6 Claims, 10 Drawing Sheets

ZIPPER HANDLE STRUCTURE

BACKGROUND OF THE INVENTION AND RELATED ART STATEMENT

The invention relates to a handle or pulling structure for opening or closing a zipper.

Sliding-type zippers have been widely used in the fields of articles for living, such as clothes and containers, industry, agriculture and the like. In the conventional zipper handle structure, a slider main portion 50, as shown in FIGS. 10(*a*) and 10(*b*), has a pillar shape engaging member 51 projecting from an upper outer circumference thereof, and a handle member 53 or 54 swingably attached to the engaging member 51 directly or through an attaching member 52 is held to open or close the zipper. The handle member 53 shown in FIG. 10(*a*) is formed of a metal flat board having an opening 53*a* on one side thereof. The handle member 53 is assembled to engage the opening 53*a* when the engaging member 53 is assembled to the slider main portion 50. The handle member 54 shown in FIG. 10(*b*) is made of a metal material or a resin, and is engaged with the engaging member 51 through an attaching member 52 having an opening 52*a*. In this case, the handle member 54 has been fixed to the attaching member 52, and when the engaging member 51 is attached to the slider main portion 50, the opening 52*a* of the attaching member 52 is assembled with the engaging member 51. As described above, the opening 53a of the handle member 53 or the opening 52*a* of the attaching member 52 is formed relatively large and is swingably engaged with the engaging member 51 on the side of the main portion 50, so that the handle member 53 or 54 can be easily held and does not become an obstacle when it is not used.

In the above-described conventional handle structures, normally, since the handle member 53 or 54 is integrally assembled with the engaging member 51 of the slider main portion 50, in case a design of the handle member 53 or 54 is changed, its exchange is very difficult. Therefore, in case the handle member of FIG. 10(*b*) is changed, for example, it is considered that engaging holes are provided on both sides of the handle member 54, and an intermediate portion of the attaching member 52 at the side of the handle member 54 is cut off to allow the parts of the attaching member 52 to engage the corresponding engaging holes of the handle member 54 to thereby attach the handle member 54 to the attaching member 52. However, in this case, the attaching strength is not enough and exchanging ability thereof becomes poor. Also, although the handle members 53 and 54 of this type are relatively small in size, they have to stand a large pulling load. Therefore, in the zipper handle, it has been desired that the attaching strength is increased, no limitation is required in its shape, and a user can easily exchange the zipper handle by himself.

In view of the above defects, the present invention has been made, and an object of the invention is to provide a novel zipper handle structure, wherein in case the handle member is attached to the attaching member on the side of the slider main portion by a later-attaching method, a user can easily exchange the handle member according to the user's preference, the attaching strength can be increased, and the thickness and shape of the handle member are not limited.

Further objects and advantages of the invention will be apparent from the following description of the invention.

SUMMARY OF THE INVENTION

In order to attain the above described objects, the present invention provides a zipper handle mechanism, which has a slider main portion to which an attaching member with an opening is swingably assembled. One end of a handle member is connected to one side or corresponding side constituting the opening of the attaching member. In the zipper handle mechanism, there is used a if connecting member having end portions to be overlapped with each other when the connecting member is folded at an intermediate portion thereof. The end portions have either an engaging shaft or an engaging hole to be engaged with or disengaged from each other. The handle member is provided with a vertical through-hole corresponding to the engaging shaft at one end side thereof. The one side of the attaching member is held inside the connecting member, and the engaging shaft is inserted into the engaging hole through the through-hole to thereby prevent the engaging shaft from being withdrawn therefrom and connect the attaching member and the handle member.

In the above described structure, the following advantages are obtained.

1) The handle member is assembled to the side of the attaching member through the connecting member by a later-attaching method, so that a user can easily exchange the handle member as desired. More specifically, in the exchange operation, the forward end side of the engaging shaft is pushed in a direction opposite to an inserting direction to release the engagement with the engaging hole. Then, a new handle member can be easily attached by holding the side of the attaching member inside the same connecting member and inserting the engaging shaft into the engaging hole on the other side through the through-hole to prevent it from being pulled out.

2) An attaching strength can be determined by an engaging strength of the engaging shaft and engaging hole, so that the strength can be set regardless of the slider main portion, attaching member and handle member. Also, since the connecting member holds the side of the attaching member therein, the connecting member can be made wide in a belt shape, so that the engaging shaft and the engaging hole to which a local load is applied are made in a large diameter to thereby easily obtain the sufficient strength. Moreover, in its using state, since the engaging shaft and engaging hole receive loads in a direction perpendicular to the pulling direction of the handle member, it is hard for the engaging shaft to be pulled out.

3) In view of a design of the structure, the handle member is attached to the side of the attaching member without directly contacting thereto, through the exclusive connecting member is provided therebetween. Also, in the relationship with the connecting member, the handle member is provided with only the through-hole on its one end side. Therefore, it is possible to design the handle member regardless of a shape, such as thickness, of the attaching member to thereby freely select any outer appearance.

4) Incidentally, it is preferable that the engaging hole of the connecting member includes a cylindrical portion projecting from an inner surface of the connecting member, and a claw portion projecting from the inner periphery of the cylindrical portion to form a smaller diameter. Also, a forward end side of the engaging shaft is positioned in the engaging hole in a state where the engaging shaft is prevented from being pulled out by the claw portion. This is because the cylindrical portion regulates a swinging movement of the engaging shaft to thereby stably and firmly keep the pulling strength or engaging force, in addition to the advantage of the outer appearance.

BRIEF DESCRIPTION OF THE DRAWINGS

FIG. 4(*b*) is a bottom view for showing the assembled state of the connecting member and the handle member;

FIG. 5(*b*) is a right side view from a direction of an arrow 5(*b*) in FIG. 4(*a*);

FIG. 5(*c*) is a left side view from a direction of an arrow 5(*c*) in FIG. 4(*a*); FIG. 5(*d*) is a sectional view taken along line 5(*d*)—5(*d*) in FIG. 4(*a*);

FIG. 8(*b*) is a bottom view for showing an assembled state of the connecting member and the handle member;

FIG. 9(*b*) is a right side view from a direction of an arrow 9(*b*) in FIG. 8(*a*);

FIG. 9(*c*) is a left side view from a direction of an arrow 9(*c*) in FIG. 8(*a*);

FIG. 9(*d*) is a sectional view taken along line 9(*d*)—9(*d*) in FIG. 8(*a*)

DETAILED DESCRIPTION OF PREFERRED EMBODIMENTS

Figure 1:
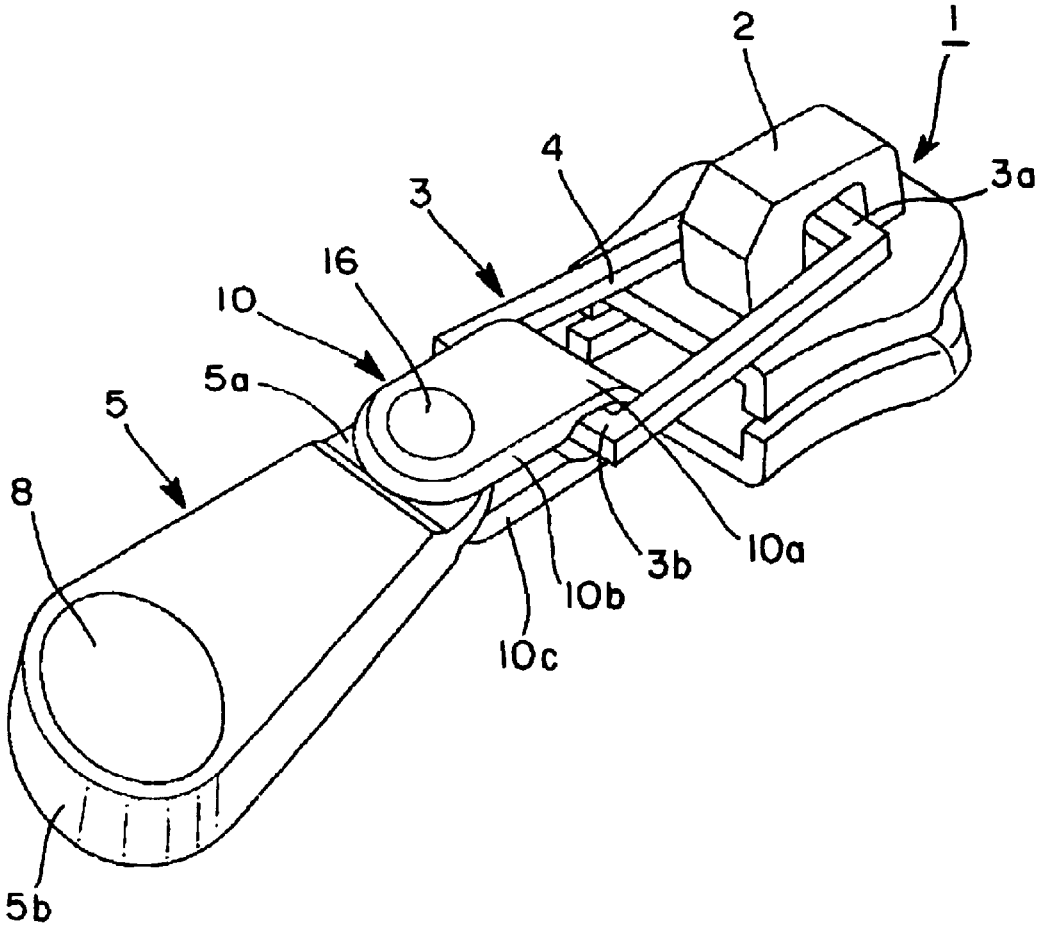
FIG. 1 is a perspective view of a zipper handle structure of a first embodiment according to the present invention.
Figure 2A:
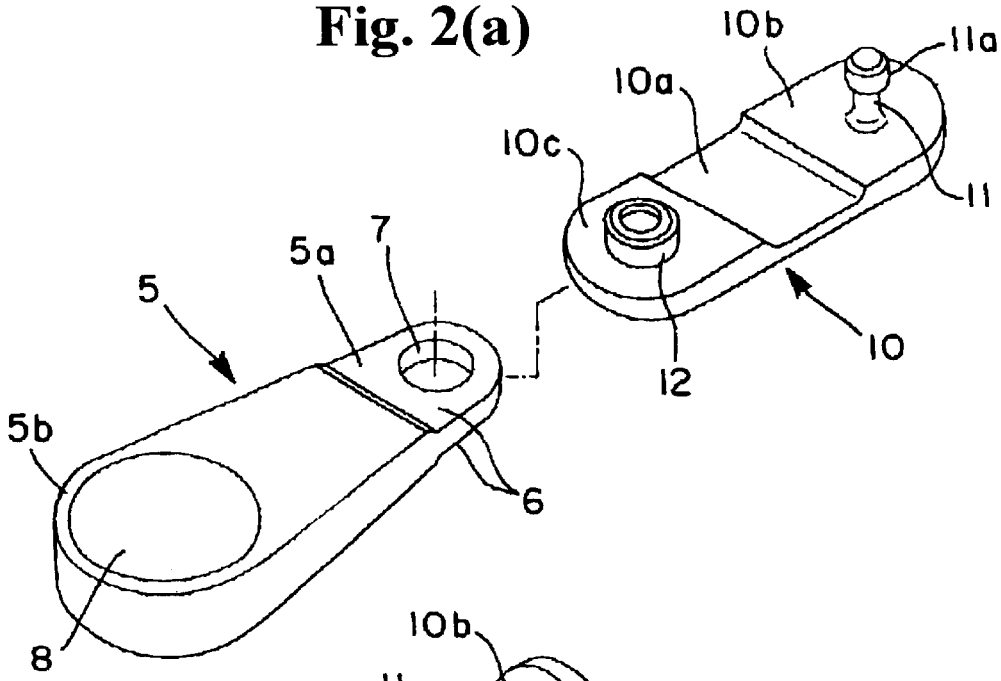
FIGS. 2(*a*), 2(*b*) and 2(*c*) are explanatory views in an assembly procedure for showing relationships between a connecting member and a handle member of the first embodiment.
Figure 2B:
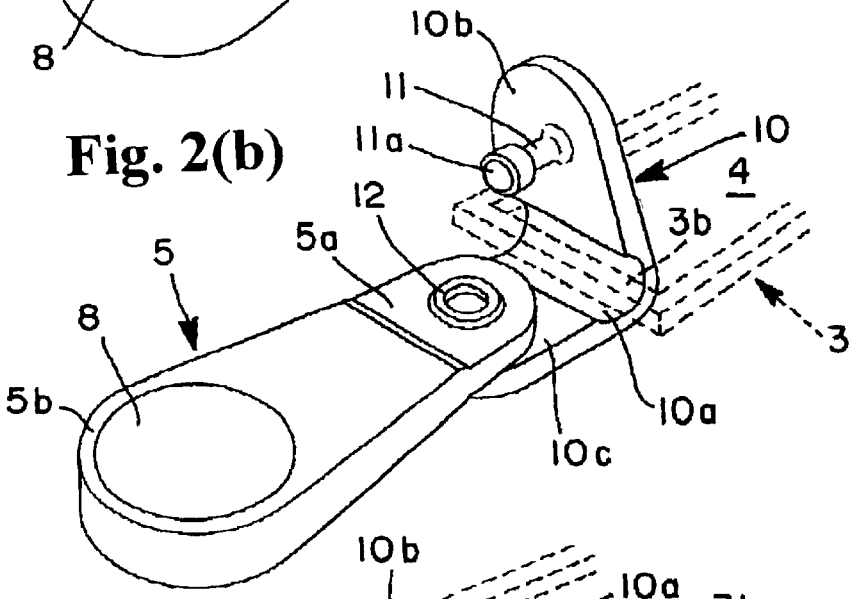
Figure 2C:
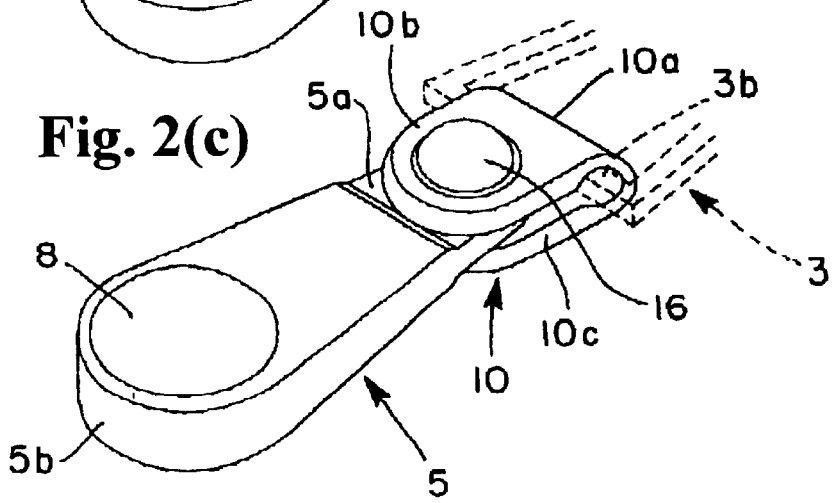
Figure 3A:
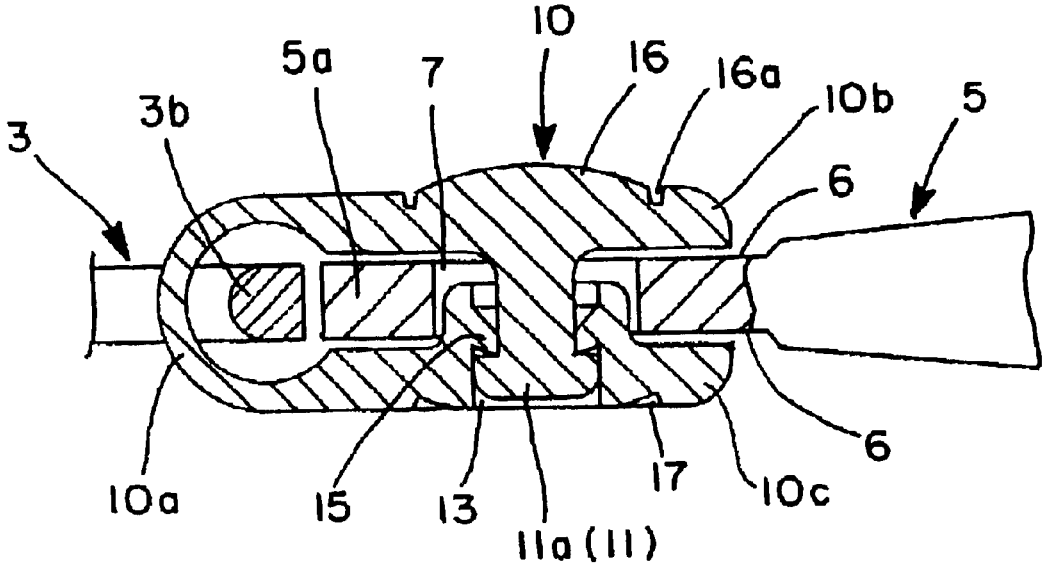
FIGS. 3(*a*) and 3(*b*) are enlarged sectional views for showing operations of the above essential parts.
Figure 3B:
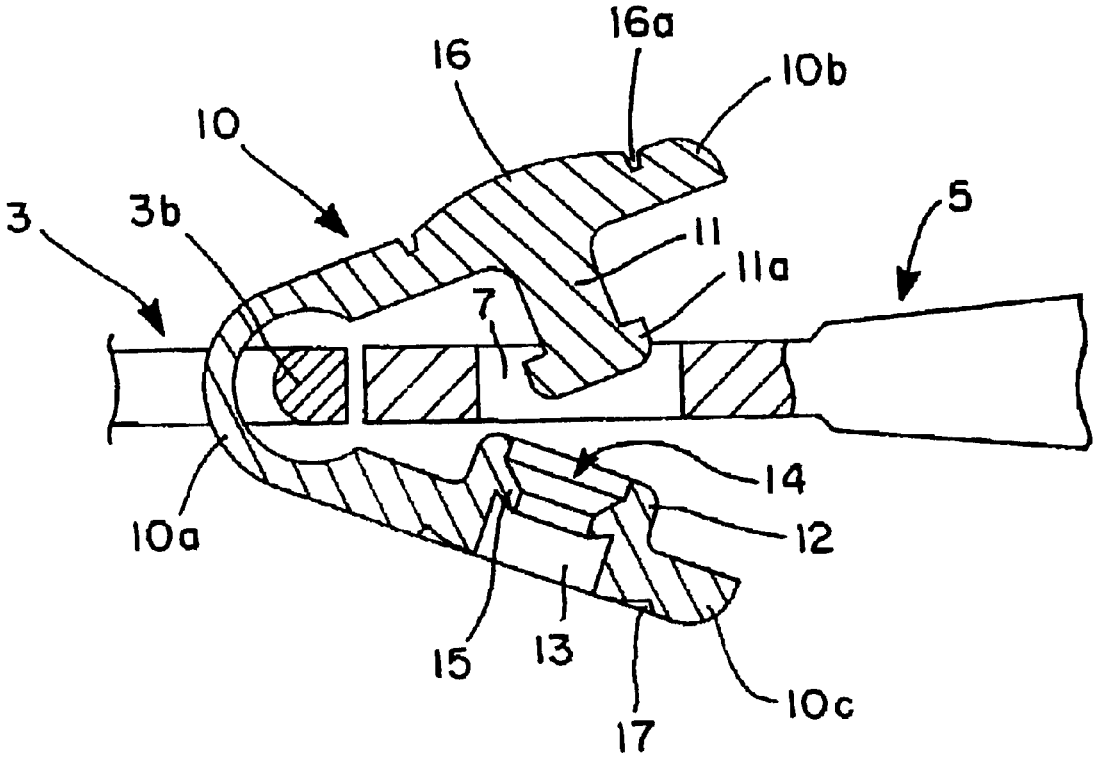
Figure 4A:
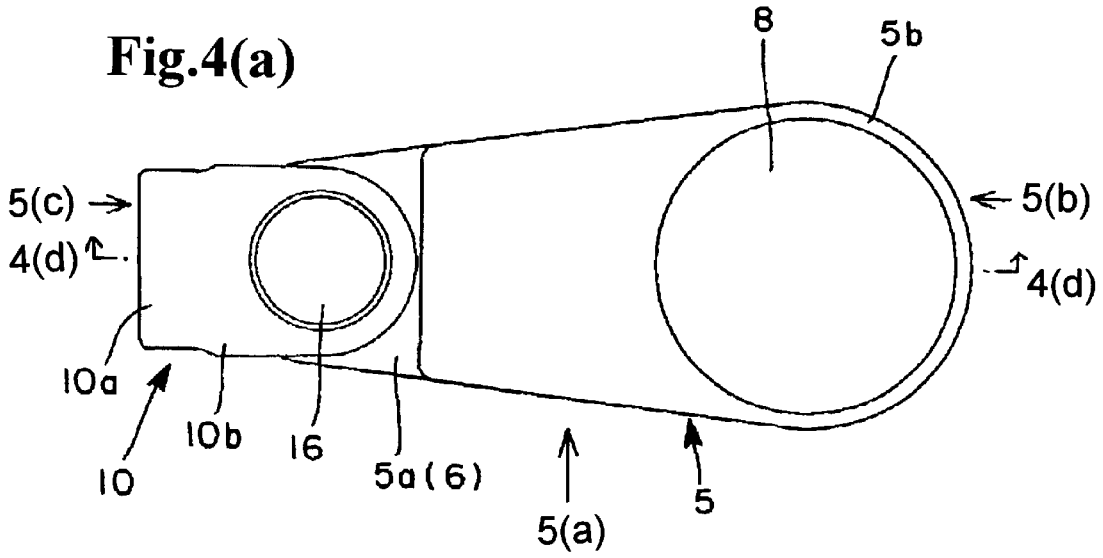
FIG. 4(*a*) is a plan view for showing an assembled state of the connecting member and the handle member.
Figure 4B:
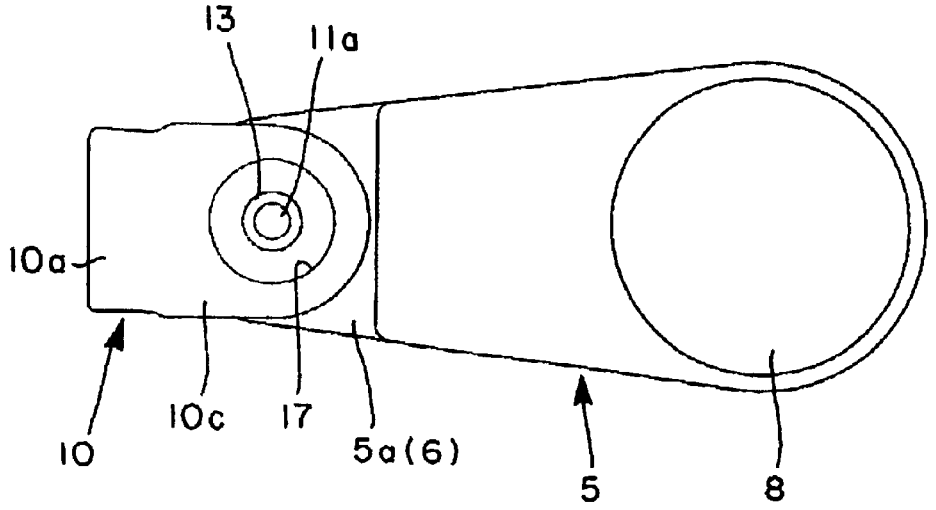
Figure 5A:
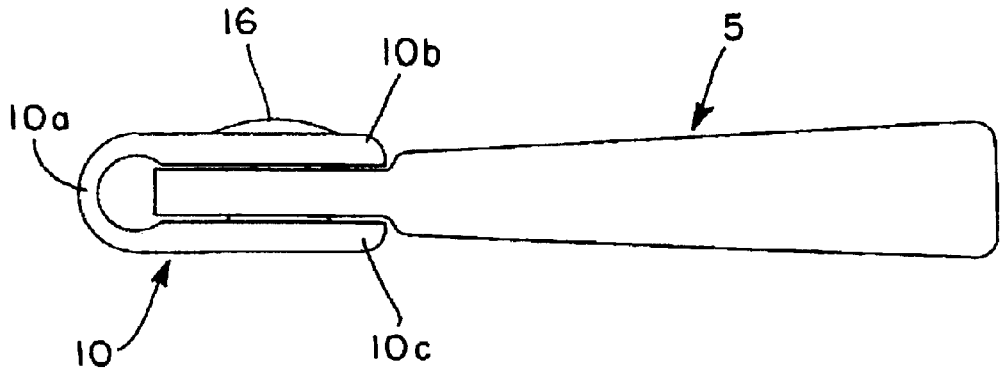
FIG. 5(*a*) is a front view from a direction of an arrow 5(*a*) in FIG. 4(*a*)
Figure 5B:
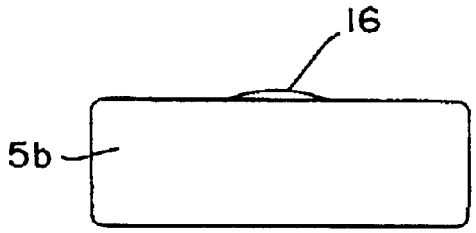
Figure 5C:
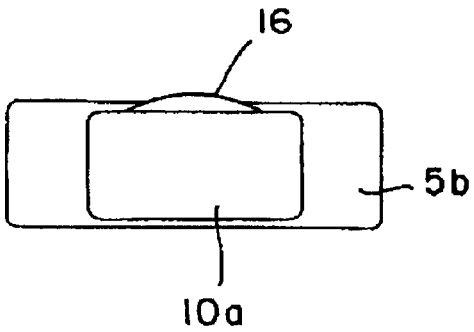
Figure 5D:
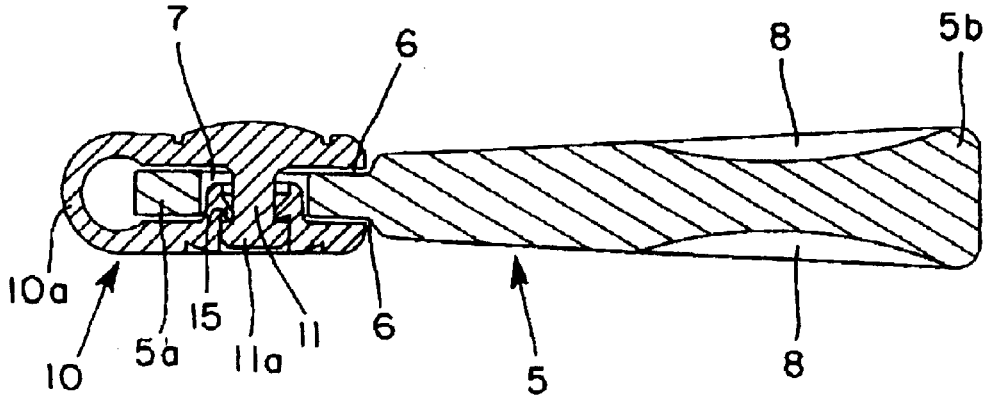

FIGS. 1 to FIG. 5(*d*) show a zipper handle structure of a first embodiment according to the present invention, wherein FIG. 1 is a perspective view showing a using state where a handle member is attached to a slider main portion; FIGS. 2(*a*)–2(*c*) are perspective views for showing relationships between the handling member and a connecting member in an assembly procedure; FIGS. 3(*a*) and 3(*b*) are sectional views of enlarged essential parts showing an attached state and a state right before attachment, respectively; FIGS. 4(*a*) and 4(*b*) are plan and bottom views where the handle member and the connecting member are connected; FIGS. 5(*a*)–5(*c*) are side views from the direction of 5(*a*), 5(*b*) and 5(*c*) in FIG. 4(*a*); and FIG. 5(*d*) is a sectional view taken along line 5(*d*)—5(*d*) in FIG. 4(*a*).

Figure 10A:
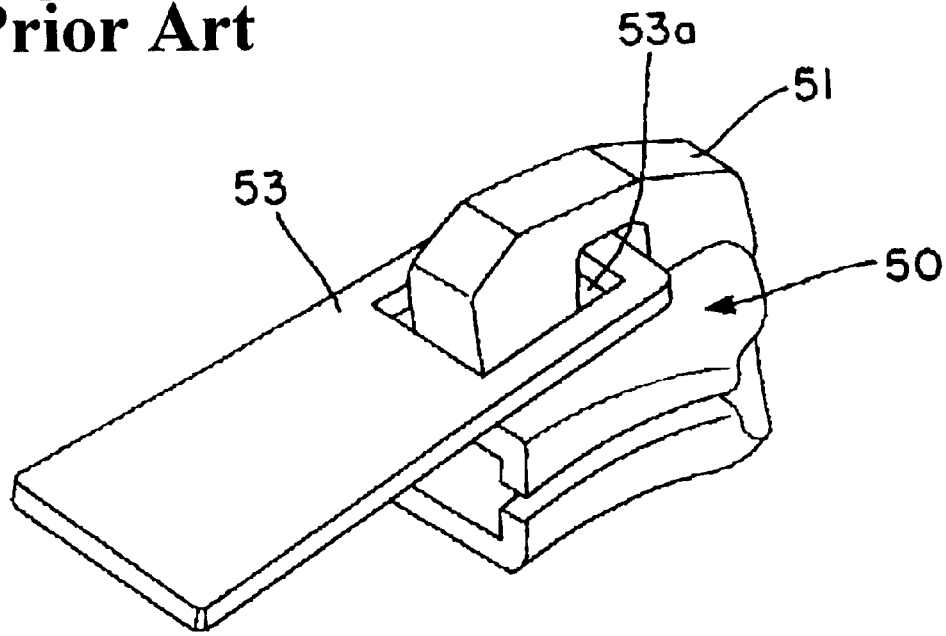
Fig. 10(a) Prior Art
FIGS. 10(*a*) and 10(*b*) show conventional handle structures.
Figure 10B:
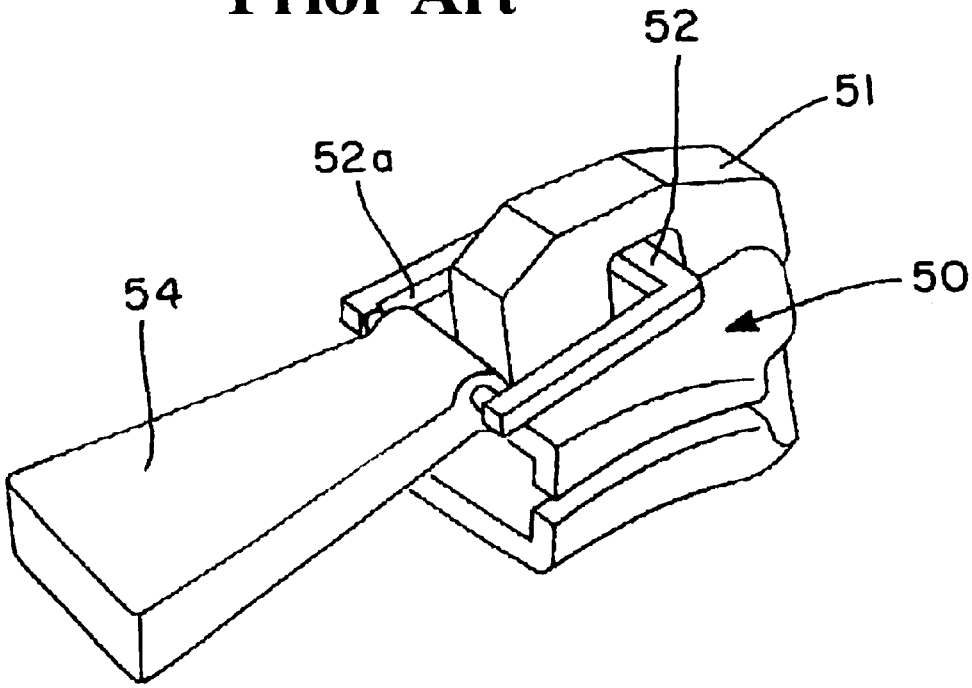
Fig. 10(b) Prior Art

In the zipper handle structure of the first embodiment, a slider main portion 1 includes an attaching member 3 engaged when Sow a pillar shape engaging member 2 is assembled with the main portion 1 in the same way in FIG. 10(*b*), and a handle member 5 is attached to the attaching member 3 through a connecting member 10 by a post-attaching method.

Here, the attaching member 3 is made of a metal material and has an approximately rectangular frame-like shape as shown in FIG. 1. One side 3*a* in a pair of front and rear opposing sides 3*a*, 3*b* for defining an opening 4 is engaged with an engaging member 2, and the other side 3*b* is connected to the handle member 5 through the connecting member 10. Incidentally, as the attaching member 3, for example, a plate member having a plurality of openings in the front and rear direction may be used. In this case, a portion for constituting the opening on the front side is engaged with the engaging member 2, and a portion for constituting the opening on the rear side is connected to the connecting member 10.

The handle member 5 is formed of a strip-shape resin molded product. Both ends of the handle member 5 are rounded, and one end portion 5*a* is made narrower than the other end 5*b*. Incidentally, in the drawings, the whole size of the handle member 5 is enlarged, but actually, the handle member 5 has a small size of about 20 to 40 mm. The end portion 5*a* has steps or reduced levels 6 in the upper and lower surfaces, as shown in FIG. 2(*a*), and is provided with a vertical through-hole 7 at the center thereof. The other end portion 5b is provided with indentations 8 on the upper and lower surfaces thereof, as shown in FIG. 5(*d*), to easily nip the handle member with fingers by utilizing the indentations 8.

The connecting member 10 is a resin molded product in a shape of a belt, as shown in FIG. 2(*a*), wherein an intermediate portion 10*a* thereof is made thinner, and both end portions 10*b*, 10*c* are approximately overlapped with each other when the intermediate portion 10*a* is bent inwardly. An engaging shaft 11 is projected from an inner surface of the end portion 10*b*, and a cylindrical portion 12 is projected from an inner surface of the end portion 10*c*. The engaging shaft 11 includes a larger diameter head portion 11*a* at its forward end, and the height to the head portion 11*a* corresponds to the thickness of the end portion 5*a* of the handle member 5. The cylindrical portion 12 together with a through-hole 13 formed in the end portion 10*c* constitutes an engaging hole 14, with or from which the engaging shaft 11 is engaged or disengaged.

More specifically, the cylindrical portion 12 is to be inserted into the through-hole 7 of the handle member 5, as shown in FIGS. 3(*a*) and 3(*b*), and includes elastic claw portions 15 projecting inwardly to form a smaller diameter hole. The claw portions 15 are provided in an inclined state from an entrance side of the cylindrical portion 12 toward the hole 13, i.e. exit side. The hole 13 is formed to house the head portion 11*a* therein in a state where the head portion 11*a* has passed through the claw portions 15 and is engaged with the claw portions 15 not to be pulled out.

Incidentally, on an outer surface of the end portion 10*b*, a pressing portion 16 projecting slightly outwardly to correspond to the engaging shaft 11 is formed to be separated by a circular sectional indentation 16*a*. On the other hand, on an outer surface of the end portion 10*c*, a shallow indentation 17 is formed around the hole 13. Incidentally, in the present structure, the engaging shaft 11 has a columnar shape and the larger diameter head portion 11*a* projects from the whole circumference of the forward end thereof. However, for example, the engaging shaft 11 may have a columnar shape with a rectangle in section or a rectangular parallelpiped, and the head portion 11*a* may project from a pair of opposing sides at the forward end thereof. In this case, the elastic claw portions 15 provided in the engaging hole 14 are projected from two portions corresponding to the pair of the opposing sides.

Next, a procedure for attaching the handle member 5 to the attaching member 2 on the side of the slider main portion 1 is explained with reference to FIGS. 2(*a*)–3(*b*).

First, as shown in FIG. 2(*b*), one end portion 5*a* of the handle member 5 is placed on an inner side of the end portion 10*c* of the connecting member 10 to thereby allow the cylinder portion 12 to fit in the through-hole 71 so that they are temporarily fixed to each other. Then, the end portion lob having passed through the opening 4 of the attaching member 3 is bent about the intermediate portion 10*a* and placed over the end portion 10*c*, i.e. one end portion 5*a* of the handle member 5. Thereafter, the engaging shaft 11 is inserted into the cylindrical portion 12 in the through-hole 7. When the shaft 11 is pushed in the inserting direction, the head portion 11a passes through the claw portions 15 while elastically bending the claw portions 15 outwardly. Thus, the head portion 11*a* is prevented from being pulled out by the claw portions 15 which have returned to an original state when the head portion 11*a* has completely passed therethrough.

FIGS. 1, 2(*c*) and 3(*a*) show a state where the handle member 5 is connected to the slider main portion through the connecting member 10. In this connecting state, the connecting member 10 holds the side 3*b* inside the intermediate portion 10*a* at which the connecting member 10 is bent, and the one end portion 5*a* of the handle member 5 is held between both ends 10*b*, 10*c*. The handle member 5 is prevented from being pulled out between the ends 10*b*, 10*c* through the engagement between the engaging shaft 11 and the engaging hole 14. The side 3*b* of the attaching member 3 is positioned in a space formed by the bent intermediate portion boa and the one end portion 5*a*.

Therefore, the handle member 5 is vertically rotated or swing around the side 3*b* through the connecting member 10, and is also horizontally rotated or swing around the engaging shaft 11. In case the handle member 5 is exchanged, after the head portion 11a of the engaging shaft 11 is pushed in a direction opposite to the inserting direction to release the engagement between the claw portions 15 of the engaging hole 14 and the head portion 11*a*, the handle member 5 is removed. Then, a new handle member is attached in accordance with the above-described procedure.

Figure 6:
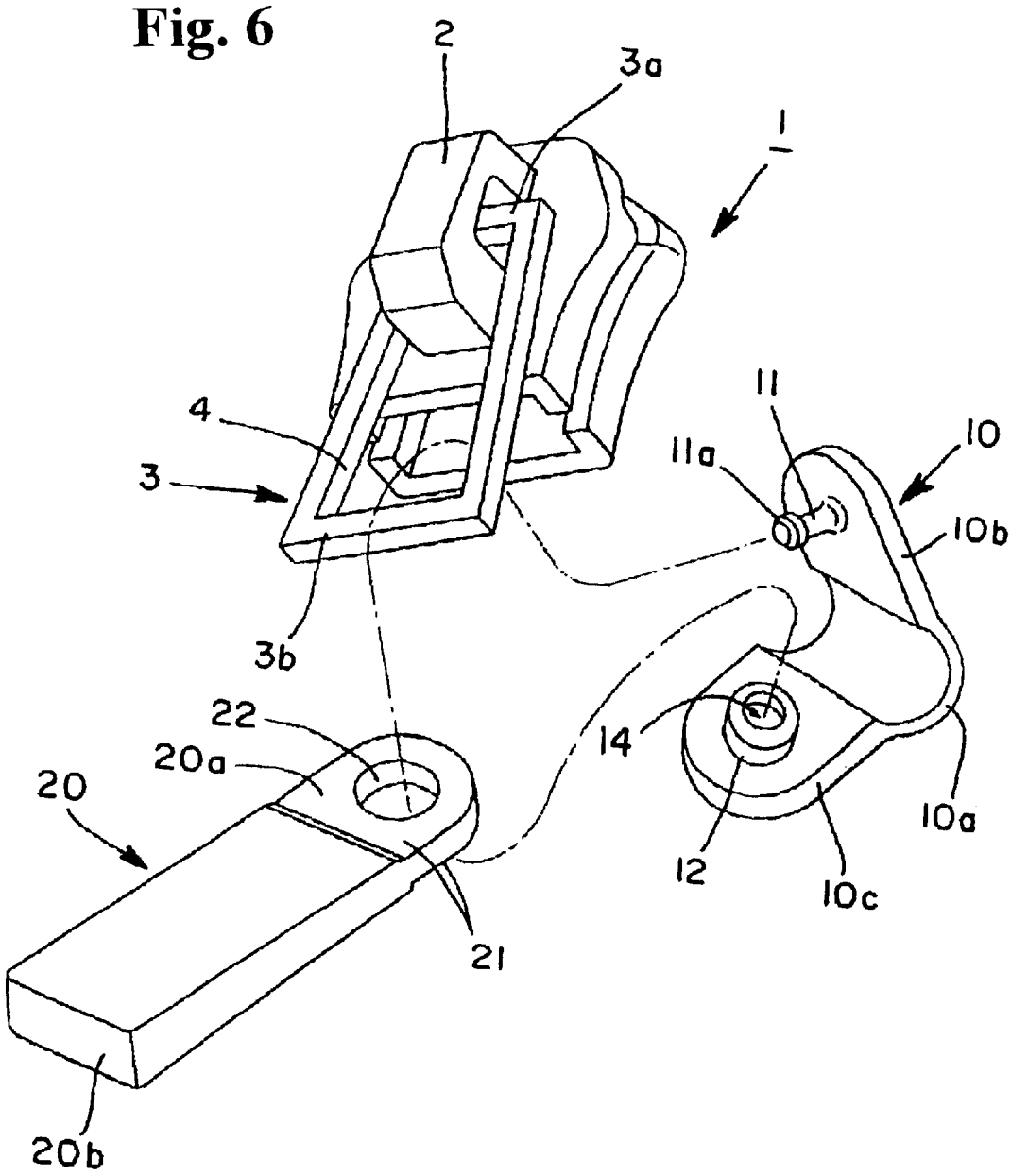
FIG. 6 is an exploded perspective view of a zipper handle structure of a second embodiment according to the present 5 invention.
Figure 7A:
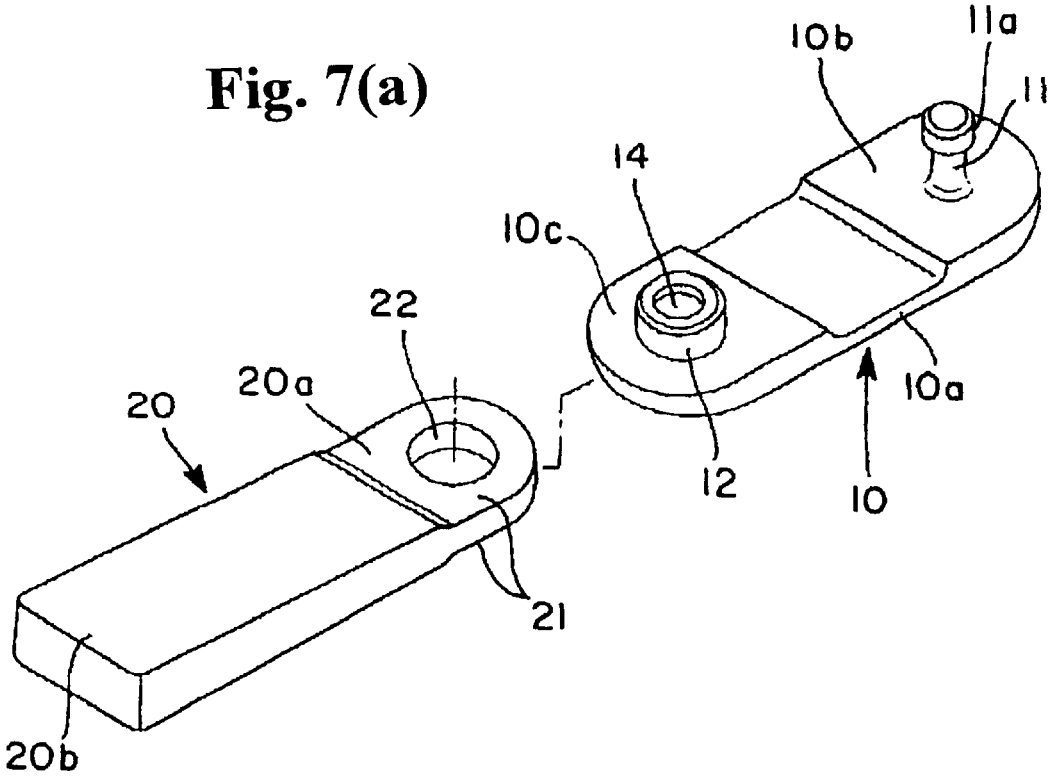
FIGS. 7(*a*) and 7(*b*) are perspective views for showing relationships between a connecting member and a handle member of the second embodiment.
Figure 7B:
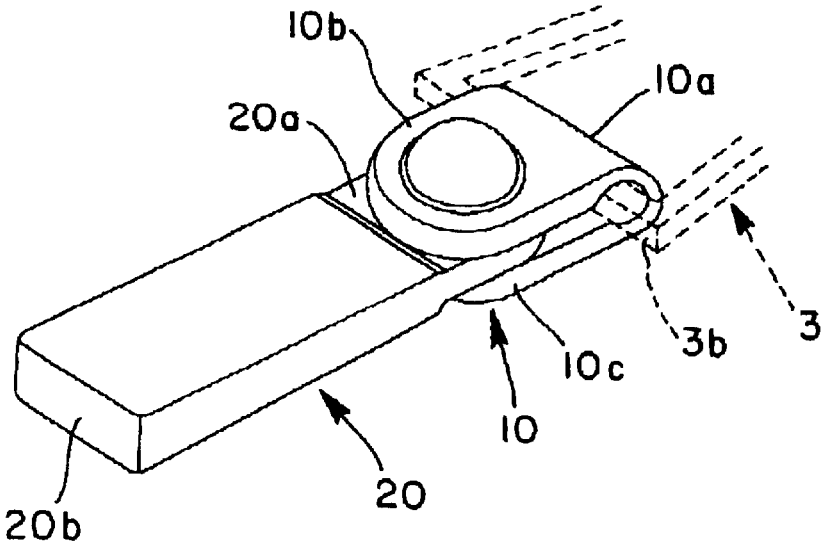
Figure 8A:
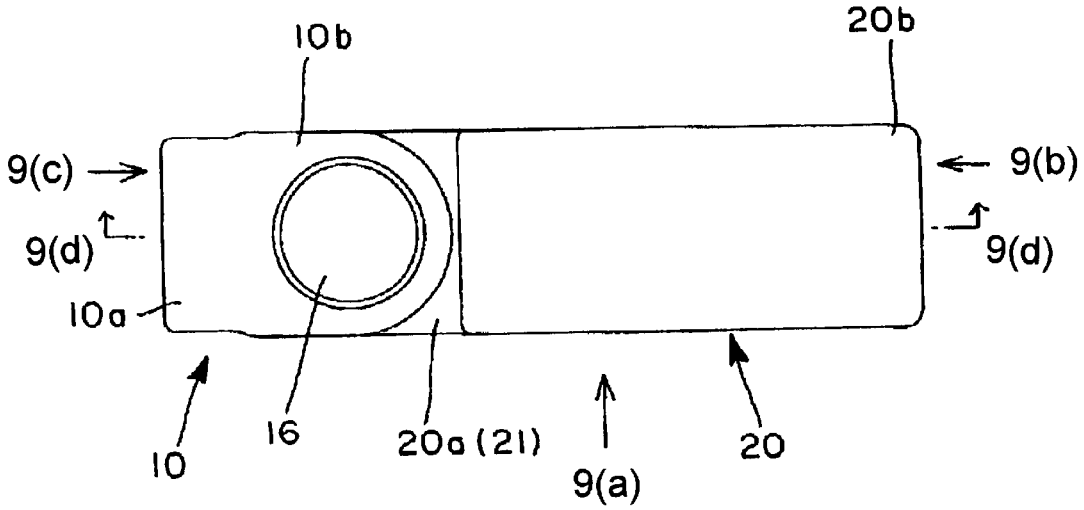
FIG. 8(*a*) is a plan view for showing an assembled state of the connecting member and the handle member.
Figure 8B:
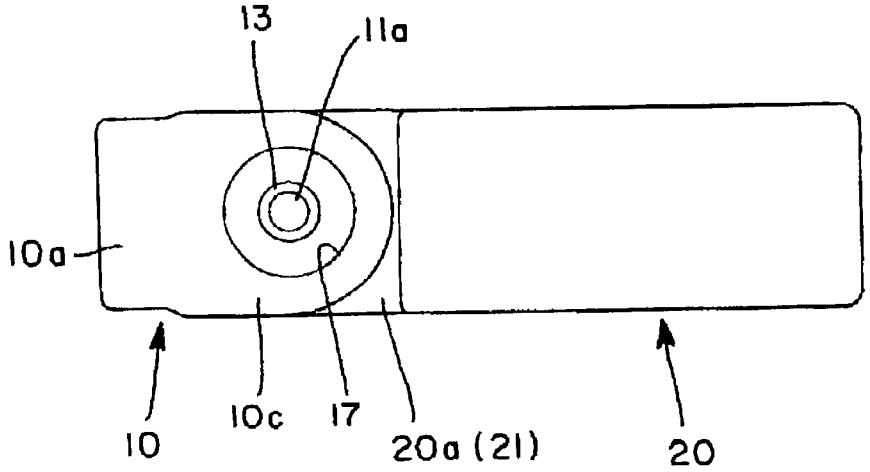
Figure 9A:
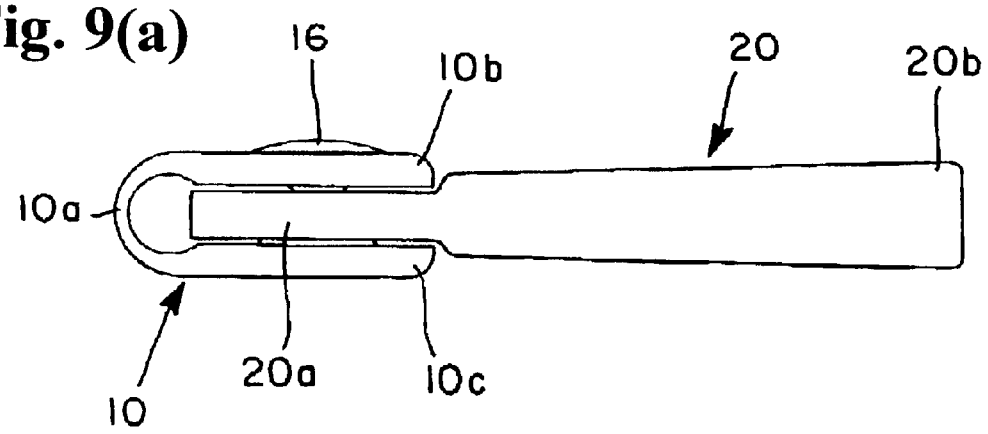
FIG. 9(*a*) is a front view from a direction of an arrow 9(*a*) in FIG. 8(*a*)
Figure 9B:
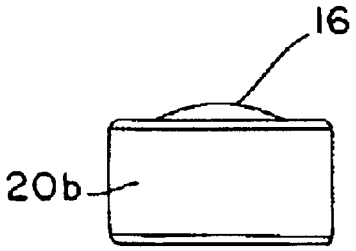
Figure 9C:
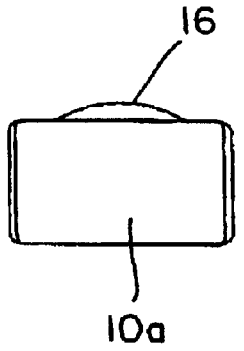
Figure 9D:
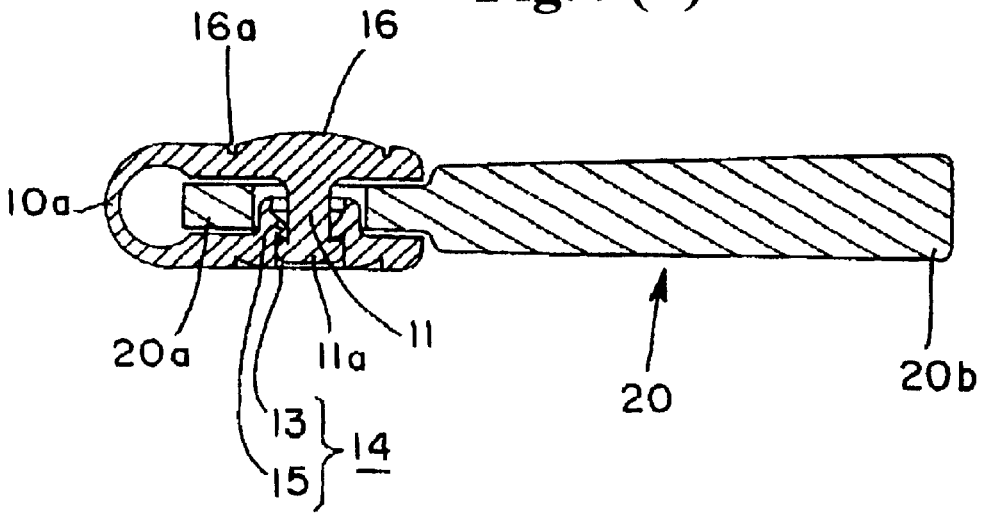

FIG. 6 to FIG. 9(*d*) show a zipper handle structure of a second embodiment according to the present invention, wherein FIG. 6 is an exploded perspective view showing a handle member together with a slider main portion and a connecting member; FIGS. 7(*a*) and 7(*b*) show a relationship between the handle member and the connecting member; FIGS. 8(*a*) and 8(*b*) are plan and bottom views showing a connected state of the handle member and the connecting member;

FIGS. 9(*a*)–9(*c*) are side views from the directions of arrows 9(*a*), 9(*b*) and 9(*c*) in FIG. 8(*a*); and FIG. 9(*d*) is a sectional view taken along line 9(*d*)—9(*d*) in FIG. 8(*a*).

In In the zipper handle structure according to the second embodiment, although the handle member is different from that of the first embodiment, the other structures are basically the same as those of the first embodiment. Therefore, in the following explanation, the same members and the same portions as in the first embodiment are designated with the same symbols, and duplicated explanations are omitted.

A handle member 20 is a resin molded product having an approximately rectangular parallelpiped, and has approximately the same width as that of the connecting member 10. The handle member 20 is smaller and simpler in the structure than the handle member 5 of the first embodiment. One end portion 20*a* of the handle member 20 is slightly thinner than the other end portion 20*b* on the other side, and provided with steps or reduced levels 21 with respect to the upper and lower surfaces thereof, respectively, and a through-hole 22 vertically passing therethrough at the center, as shown in FIG. 7(*a*). The cylindrical portion 12 of the connecting member 10 is fitted into the through-hole 22 as described above, and the engaging shaft 11 is held in the cylindrical portion 12 not to be pulled out. The handle member 20 is also connected to the side 3*b* of the attaching member 3 on the side of the slider main portion 1 in the same manner, by using the same connecting member 10, as described above.

As described above, in the zipper handle structure according to the present invention, the attaching member on the side of the zipper main portion and the handle member are connected by using the connecting member having the engaging hole and the engaging shaft at both ends. When the handle member is assembled, the end sides with the engaging hole and the engaging shaft of the connecting member are overlapped with each other by bending at the center thereof, and the engaging shaft is inserted through the through-hole of the handle member into the engaging hole of the connecting member in a state where the one side of the attaching member is held inside the connecting member. Thus, in the structure of the invention, in case the handle member is exchanged with a new one, as compared with the conventional structures, the exchange work can be carried out simpler. Also, the attaching strength can be increased only by setting the connecting member, i.e. engaging shaft and engaging hole, without being influenced by the attaching member, and the thickness and shape of the handle member are not limited to thereby provide a novel and stable zipper handle structure.

While the invention has been explained with reference to the specific embodiments of the invention, the explanation is illustrative and the invention is limited only by the appended claims.

What is claimed is:

1. A zipper handle structure comprising:

an attaching member to be swingably attached to a slider main portion of a zipper and having an opening and a side portion, a handle member having a through hole at one side, and a connecting member for connecting the attaching member and the handle member, said connecting member including a first end portion with an engaging shaft, a second end portion with an engaging hole to be detachably engageable with the engaging shaft, and a center portion between the firot and second end portions, said first and second end portions being overlapped to engage the engaging shaft with the engaging hole while the side portion of the attaching member is held between the first and second end portions adjacent the center portion and the engaging shaft is located in the through hole of the handle member so that the handle member is swingably connected to the attaching member.

2. A zipper handle structure according to claim 1, wherein said second end portion includes a cylindrical portion projecting from an inner surface toward the first end portion and surrounding the engaging hole, and a claw portion projecting inwardly from an inner periphery of the cylindrical portion to form a small diameter portion so that when the engaging shaft is positioned in the engaging hole, the engaging shaft is prevented from being pulled out by the claw portion.

3. A zipper handle structure according to claim 2, wherein said engaging shaft is formed of a shaft portion and a head portion formed at an end of the shaft portion, said head portion having a diameter greater than that of the shaft to engage the claw portion.

4. A zipper handle structure according to claim 3, wherein said second end portion has a concave at a side opposite to the cylindrical portion to surround the engaging hole, said head portion being located in the concave when the engaging shaft is disposed in the engaging hole.

5. A zipper handle structure according to claim 2, wherein said through hole of the handle portion has a diameter greater than that of the cylindrical portion to receive the cylindrical portion therein.

6. A zipper handle structure according to claim 2, wherein said attaching member is a rectangular frame having said opening and said side portion at one side, said frame passing through a hole of the slider main portion.

* * * * *